US012168984B2

(12) United States Patent
Snell et al.

(10) Patent No.: US 12,168,984 B2
(45) Date of Patent: Dec. 17, 2024

(54) SYSTEM AND METHOD FOR DIRECTING FLUID FLOW IN A COMPRESSOR

(71) Applicant: Johnson Controls Tyco IP Holdings LLP, Milwaukee, WI (US)

(72) Inventors: Paul William Snell, York, PA (US); Bryson Lee Sheaffer, Mechanicsburg, PA (US); Florin Valeriu Iancu, Silver Spring, MD (US)

(73) Assignee: TYCO FIRE & SECURITY GMBH, Neuhausen am Rheinfall (CH)

( * ) Notice: Subject to any disclaimer, the term of this patent is extended or adjusted under 35 U.S.C. 154(b) by 0 days.

(21) Appl. No.: 18/018,235

(22) PCT Filed: Jul. 30, 2021

(86) PCT No.: PCT/US2021/044013
§ 371 (c)(1),
(2) Date: Jan. 26, 2023

(87) PCT Pub. No.: WO2022/026897
PCT Pub. Date: Feb. 3, 2022

(65) Prior Publication Data

US 2023/0272804 A1 Aug. 31, 2023

Related U.S. Application Data

(60) Provisional application No. 63/059,006, filed on Jul. 30, 2020.

(51) Int. Cl.
*F04D 29/28* (2006.01)
*F04D 17/10* (2006.01)
(Continued)

(52) U.S. Cl.
CPC ..... *F04D 29/284* (2013.01); *F04D 17/10* (2013.01); *F25B 1/005* (2013.01); *F25B 1/04* (2013.01);
(Continued)

(58) Field of Classification Search
CPC ..... F04D 29/284; F04D 17/10; F04D 29/684; F25B 1/005; F25B 1/04; F25B 25/005;
(Continued)

(56) References Cited

U.S. PATENT DOCUMENTS 3,165,905 A * 1/1965 Ware ..... F25B 31/006 62/505
3,226,940 A * 1/1966 Jekat ..... F04D 17/127 415/206
(Continued)

FOREIGN PATENT DOCUMENTS

FR 2588066 A1 * 4/1987
JP H07167099 A 7/1995
(Continued)

OTHER PUBLICATIONS

PCT International Search Report and Written Opinion for PCT Application No. PCT/US2021/044013, mailed Nov. 8, 2021, 10 pgs.

*Primary Examiner* — Brian Christopher Delrue
(74) *Attorney, Agent, or Firm* — Fletcher Yoder, P.C.

(57) ABSTRACT

A compressor for a heating, ventilating, air conditioning, and refrigeration (HVAC&R) system includes an impeller that has a hub defining an impeller tip, a plurality of blades coupled to the hub and defining a plurality of flow paths configured to direct a primary flow of working fluid therethrough, and a shroud coupled to the plurality of blades. The shroud includes a shroud tip disposed upstream of the impeller tip relative to a flow direction of the primary flow of working fluid through the plurality of flow paths.

20 Claims, 8 Drawing Sheets

(51) Int. Cl.

| | |
|---|---|
| ***F25B 1/00*** | (2006.01) |
| ***F25B 1/04*** | (2006.01) |
| ***F25B 25/00*** | (2006.01) |
| ***F25B 31/02*** | (2006.01) |

(52) U.S. Cl.
CPC ..... *F25B 25/005* (2013.01); *F25B 31/02* (2013.01); *F25B 2339/047* (2013.01); *F25B 2400/23* (2013.01)

(58) Field of Classification Search
CPC ..... F25B 31/02; F25B 2339/047; F25B 2400/23; F25B 2400/13
See application file for complete search history.

(56) References Cited

U.S. PATENT DOCUMENTS

| | | | | |
|---|---|---|---|---|
| 4,141,708 | A * | 2/1979 | Lavigne, Jr. | F25B 1/053 62/505 |
| 9,382,911 | B2 * | 7/2016 | Sun | F04D 27/0238 |
| 10,267,539 | B2 * | 4/2019 | Sishtla | F25B 1/053 |
| 2003/0094007 | A1 * | 5/2003 | Choi | F25B 41/20 62/505 |
| 2006/0277941 | A1 * | 12/2006 | Lifson | F25B 1/04 62/513 |
| 2007/0212232 | A1 * | 9/2007 | De Larminat | F04C 29/045 417/83 |
| 2011/0129344 | A1 | 6/2011 | Burgess et al. | |
| 2011/0194931 | A1 | 8/2011 | Swiatek et al. | |
| 2012/0011866 | A1 * | 1/2012 | Scarcella | F25B 41/39 62/79 |
| 2014/0182317 | A1 * | 7/2014 | Sishtla | F04D 27/0238 415/116 |
| 2015/0128640 | A1 * | 5/2015 | Sun | F25B 1/10 415/55.5 |
| 2017/0176053 | A1 * | 6/2017 | Sishtla | F04D 27/0223 |
| 2020/0018325 | A1 | 1/2020 | Snell | |
| 2021/0156597 | A1 * | 5/2021 | Bandhauer | F25B 6/04 |

FOREIGN PATENT DOCUMENTS

| | | | |
|---|---|---|---|
| JP | 2009068423 | A | 4/2009 |
| JP | 2014137008 | A | 7/2014 |
| KR | 20190016267 | A | 2/2019 |
| WO | WO-2017023578 | A1 * | 2/2017 |
| WO | WO-2023224972 | A1 * | 11/2023 |
| WO | WO-2024020019 | A1 * | 1/2024 |

* cited by examiner

SYSTEM AND METHOD FOR DIRECTING FLUID FLOW IN A COMPRESSOR

CROSS REFERENCE TO RELATED APPLICATION

This application claims priority from and the benefit of U.S. Provisional Patent Application Ser. No. 63/059,006, entitled "SYSTEM AND METHOD FOR DIRECTING FLUID FLOW IN A COMPRESSOR," filed Jul. 30, 2020, which is hereby incorporated by reference in its entirety for all purposes.

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Chiller systems, or vapor compression systems, utilize a working fluid (e.g., a refrigerant) that changes phases between vapor, liquid, and combinations thereof in response to exposure to different temperatures and pressures within components of the chiller system. The chiller system may place the working fluid in a heat exchange relationship with a conditioning fluid (e.g., water) and may deliver the conditioning fluid to conditioning equipment and/or a conditioned environment serviced by the chiller system. In such applications, the conditioning fluid may be directed through downstream equipment, such as air handlers, to condition other fluids, such as air in a building.

In typical chillers, the conditioning fluid is cooled by an evaporator that absorbs heat from the conditioning fluid by evaporating working fluid. The working fluid is then compressed by a compressor and transferred to a condenser. In the condenser, the working fluid is cooled, typically by a water or air flow, and condensed into a liquid. In some conventional designs, economizers are utilized in the chiller system to improve performance. In systems that employ economizers, the condensed working fluid may be directed to the economizer where the liquid working fluid at least partially evaporates. The resulting vapor may be extracted from the economizer and redirected to the compressor, while the remaining liquid working fluid from the economizer is directed to the evaporator. Unfortunately, the vapor working fluid directed from the economizer to the compressor may be introduced to the compressor at a pressure that provides a limited performance benefit in certain conditions.

SUMMARY

A summary of certain embodiments disclosed herein is set forth below. It should be understood that these aspects are presented merely to provide the reader with a brief summary of these certain embodiments and that these aspects are not intended to limit the scope of this disclosure. Indeed, this disclosure may encompass a variety of aspects that may not be set forth below.

In one embodiment, a compressor for a heating, ventilating, air conditioning, and refrigeration (HVAC&R) system includes an impeller having a hub defining an impeller tip, a plurality of blades coupled to the hub, where the plurality of blades defines a plurality of flow paths configured to direct a primary flow of working fluid therethrough, and a shroud coupled to the plurality of blades, where the shroud includes a shroud tip disposed upstream of the impeller tip relative to a flow direction of the primary flow of working fluid through the plurality of flow paths.

In one embodiment, a compressor for a heating, ventilating, air conditioning, and refrigeration (HVAC&R) system includes an impeller that has a hub with a first radial tip, a plurality of blades extending from the hub and defining a plurality of flow paths configured to direct a primary flow of working fluid therethrough, and a shroud coupled to the plurality of blades and having a second radial tip disposed upstream of the first radial tip of the hub relative to a first flow direction of the primary flow of working fluid through the plurality of flow paths. The compressor also includes a compressor housing, in which the impeller is disposed within the compressor housing, and the compressor housing has a working fluid flow path extending therethrough and configured to receive a vapor working fluid from an economizer and direct the vapor working fluid into the plurality of flow paths. The compressor further includes a plurality of vanes disposed within the working fluid flow path and configured to adjust a second flow direction of the vapor working fluid through the working fluid flow path.

In one embodiment, a compressor for a heating, ventilating, air conditioning, and refrigeration (HVAC&R) system includes a housing having a vapor working fluid flow path extending therethrough and configured to receive a vapor working fluid from an economizer of the HVAC&R system. The compressor also includes an impeller disposed within the housing. The impeller has a plurality of blades defining a plurality of flow paths configured to direct a primary flow of working fluid therethrough, with each blade of the plurality of blades having a first tip, and the impeller has a shroud coupled to the plurality of blades and having a second tip disposed upstream of the first tip of each blade of the plurality of blades relative to a flow direction of the primary flow of working fluid through the plurality of flow paths. The compressor further includes a stationary vane disposed within the vapor working fluid flow path and configured to adjust a flow direction of the vapor working fluid upstream of the second tip of shroud and direct the vapor working fluid into the plurality of flow paths downstream of the second tip of the shroud and upstream of the first tip of each blade of the plurality of blades.

DRAWINGS

Various aspects of this disclosure may be better understood upon reading the following detailed description and upon reference to the drawings in which.

DETAILED DESCRIPTION

Figure 1:
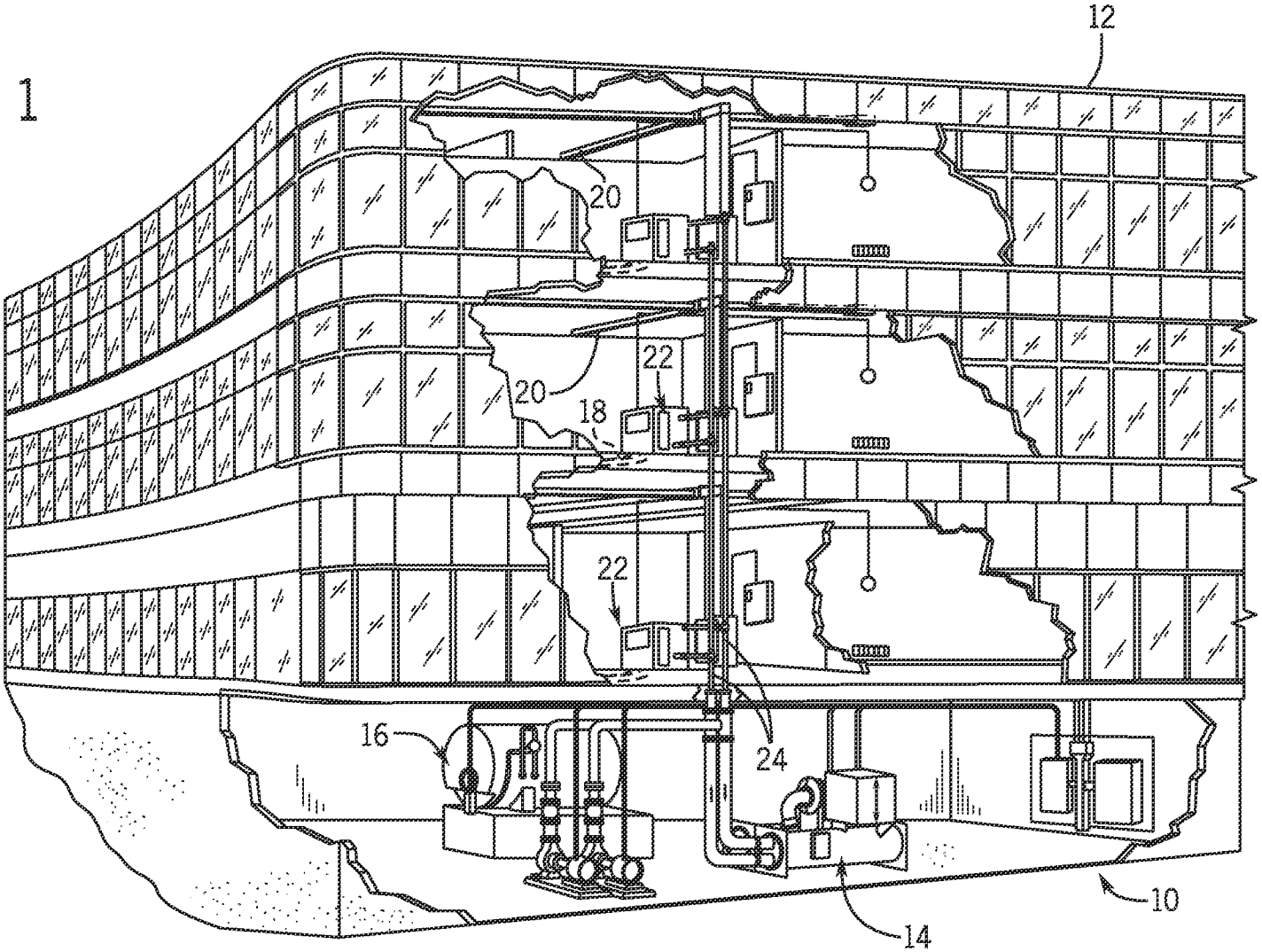
FIG. 1 is a perspective view of a building that may utilize an embodiment of a heating, ventilation, air conditioning, and refrigeration (HVAC&R) system in a commercial setting, in accordance with an aspect of the present disclosure.

One or more specific embodiments will be described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

Embodiments of the present disclosure relate to an HVAC&R system having a vapor compression system with a compressor and an economizer. Specifically, the vapor compression system includes a working fluid (e.g., refrigerant) circuit with a compressor, a condenser, an evaporator, an expansion device, and an economizer. In operation, the compressor pressurizes a working fluid within the working fluid circuit and directs the working fluid to the condenser, which condenses the working fluid. The condensed working fluid is directed to the economizer, which "flashes" the working fluid at a pressure that is between a pressure of the condenser and a pressure of the evaporator to produce a two-phase working fluid. From the economizer, vapor working fluid is directed to the compressor to be recompressed and condensed, and liquid working fluid is directed to the evaporator for evaporation via heat exchange with a conditioning fluid.

It is now recognized that controlling flow of the vapor working fluid into the compressor may enable improved performance of the vapor compression system. More specifically, present embodiments are directed to a system and method configured to control a pressure at which the vapor working fluid is introduced into the compressor from the economizer. For example, a compressor (e.g., a single stage centrifugal compressor) may be configured to compress a working fluid via rotation of an impeller and via a diffuser passage disposed downstream of the impeller relative to a flow of the working fluid through the compressor. During operation of the HVAC system, vapor working fluid may be directed into the compressor from a suction inlet of the compressor (e.g., from the evaporator). Operation of the impeller may provide approximately two-thirds of the total working fluid pressure increase provided by the compressor (e.g., two-thirds of compressor lift) to the working fluid received via the suction inlet, and the diffuser passage may provide approximately one-third of the total working fluid pressure increase provided by the compressor (e.g., one-third of compressor lift) to the working fluid received via the suction inlet.

Furthermore, vapor working fluid may be directed into the compressor between the impeller and the diffuser passage (e.g., where two-thirds of compressor lift has been provided to the vapor working fluid received via the suction inlet). However, it is now recognized that it may be desirable to introduce the vapor working fluid from the economizer into the compressor at a pressure that is lower than the pressure of the working fluid between the impeller and the diffuser passage (e.g., a pressure below where two-thirds of compressor lift has been provided to the vapor working fluid received via the suction inlet). For example, it may be desirable to introduce the vapor working fluid from the economizer upstream of a location between the impeller and the diffuser passage. Accordingly, present embodiments are directed to a compressor having an impeller with a partial shroud. As discussed in detail below, the compressor includes a working fluid flow path (e.g., a secondary flow path) configured to direct vapor working fluid from the economizer into the compressor flow path (e.g., a primary flow path through which vapor working fluid received via the suction inlet is directed) at a location upstream of an impeller tip (e.g., upstream of the location between the impeller and the diffuser passage). Specifically, the working fluid flow path directs the vapor working fluid into an unshrouded portion of the impeller and between blades of the impeller. In this way, the vapor working fluid from the economizer is introduced into the impeller at a desired pressure, and the vapor working fluid may mix with a main working fluid flow directed through the compressor for further compression and may then be discharged from the compressor. Introducing the vapor working fluid from the economizer into the compressor at the location upstream of the impeller tip may improve mixture between the vapor working fluid flowing through the working fluid flow path (e.g., from the economizer) and the vapor working fluid flowing through the compressor flow path (e.g., from the suction inlet and evaporator) and improve operation of the compressor to compress the working fluid.

Turning now to the drawings, FIG. 1 is a perspective view of an embodiment of an environment for a heating, ventilation, air conditioning, and refrigeration (HVAC&R) system 10 in a building 12 for a typical commercial setting. The HVAC&R system 10 may include a vapor compression system 14 (e.g., a chiller) that supplies a chilled liquid, which may be used to cool the building 12. The HVAC&R system 10 may also include a boiler 16 to supply warm liquid to heat the building 12 and an air distribution system which circulates air through the building 12. The air distribution system can also include an air return duct 18, an air supply duct 20, and/or an air handler 22. In some embodiments, the air handler 22 may include a heat exchanger that is connected to the boiler 16 and the vapor compression system 14 by conduits 24. The heat exchanger in the air handler 22 may receive either heated liquid from the boiler 16 or chilled liquid from the vapor compression system 14, depending on the mode of operation of the HVAC&R system 10. The HVAC&R system 10 is shown with a separate air handler on each floor of building 12, but in other embodiments, the HVAC&R system 10 may include air handlers 22 and/or other components that may be shared between or among floors.

Figure 2:
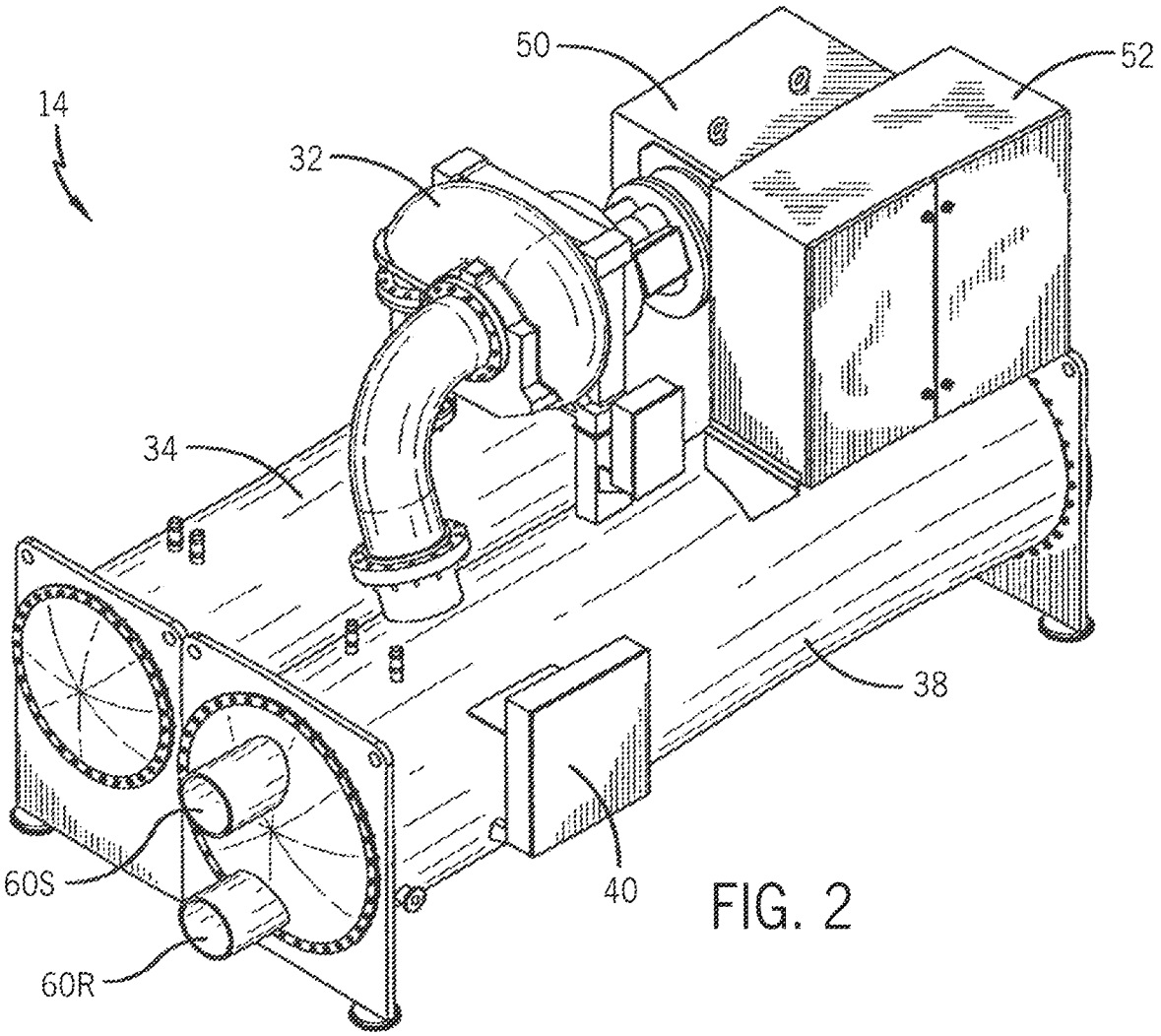
FIG. 2 is a perspective view of an embodiment of a vapor compression system, in accordance with an aspect of the present disclosure.
Figure 3:
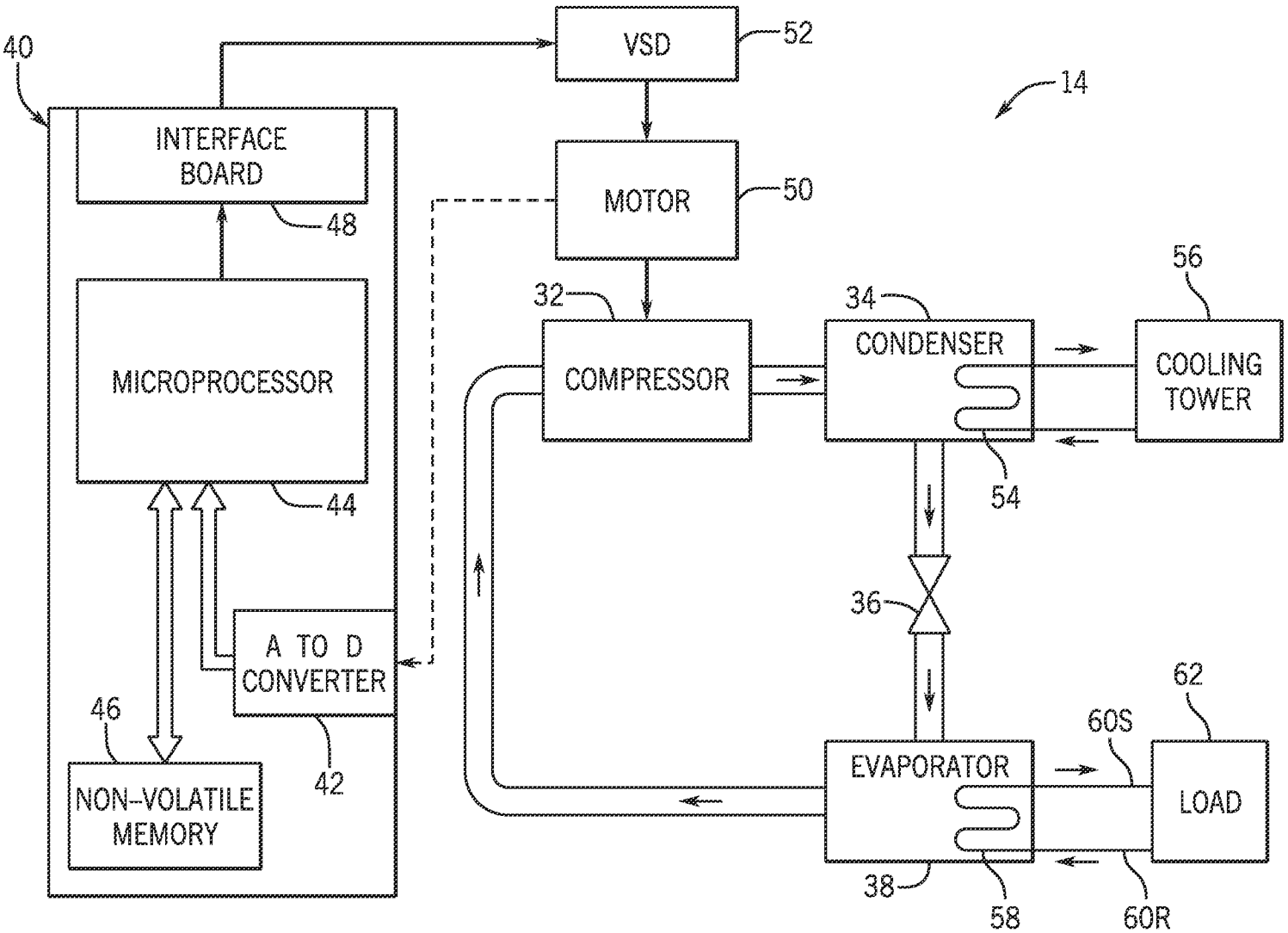
FIG. 3 is a schematic of an embodiment of a vapor compression system, in accordance with an aspect of the present disclosure.

FIGS. 2 and 3 illustrate embodiments of the vapor compression system 14 that can be used in the HVAC&R system 10. The vapor compression system 14 may circulate a refrigerant through a circuit starting with a compressor 32. The circuit may also include a condenser 34, an expansion valve(s) or device(s) 36, and a liquid chiller or an evaporator 38. The vapor compression system 14 may further include a control panel 40 that has an analog to digital (A/D) converter 42, a microprocessor 44, a non-volatile memory 46, and/or an interface board 48.

Some examples of fluids that may be used as refrigerants in the vapor compression system 14 are hydrofluorocarbon (HFC) based refrigerants, for example, R-410A, R-407, R-134a, hydrofluoro olefin (HFO), "natural" refrigerants like ammonia (NH3), R-717, carbon dioxide (CO2), R-744, or hydrocarbon based refrigerants, water vapor, or any other suitable refrigerant. In some embodiments, the vapor compression system 14 may be configured to efficiently utilize refrigerants having a normal boiling point of about 19 degrees Celsius (66 degrees Fahrenheit) at one atmosphere of pressure, also referred to as low pressure refrigerants, versus a medium pressure refrigerant, such as R-134a. As used herein, "normal boiling point" may refer to a boiling point temperature measured at one atmosphere of pressure.

In some embodiments, the vapor compression system 14 may use one or more of a variable speed drive (VSDs) 52, a motor 50, the compressor 32, the condenser 34, the expansion valve or device 36, and/or the evaporator 38. The motor 50 may drive the compressor 32 and may be powered by a variable speed drive (VSD) 52. The VSD 52 receives alternating current (AC) power having a particular fixed line voltage and fixed line frequency from an AC power source, and provides power having a variable voltage and frequency to the motor 50. In other embodiments, the motor 50 may be powered directly from an AC or direct current (DC) power source. The motor 50 may include any type of motor that can be powered by a VSD or directly from an AC or DC power source, such as a switched reluctance motor, an induction motor, an electronically commutated permanent magnet motor, or another suitable motor.

The compressor 32 compresses a refrigerant vapor and delivers the vapor to the condenser 34 through a discharge passage. In some embodiments, the compressor 32 may be a centrifugal compressor. The refrigerant vapor delivered by the compressor 32 to the condenser 34 may transfer heat to a cooling fluid (e.g., water or air) in the condenser 34. The refrigerant vapor may condense to a refrigerant liquid in the condenser 34 as a result of thermal heat transfer with the cooling fluid. The liquid refrigerant from the condenser 34 may flow through the expansion device 36 to the evaporator 38. In the illustrated embodiment of FIG. 3, the condenser 34 is water cooled and includes a tube bundle 54 connected to a cooling tower 56, which supplies the cooling fluid to the condenser 34.

The liquid refrigerant delivered to the evaporator 38 may absorb heat from another cooling fluid, which may or may not be the same cooling fluid used in the condenser 34. The liquid refrigerant in the evaporator 38 may undergo a phase change from the liquid refrigerant to a refrigerant vapor. As shown in the illustrated embodiment of FIG. 3, the evaporator 38 may include a tube bundle 58 having a supply line 60S and a return line 60R connected to a cooling load 62. The cooling fluid of the evaporator 38 (e.g., water, ethylene glycol, calcium chloride brine, sodium chloride brine, or any other suitable fluid) enters the evaporator 38 via return line 60R and exits the evaporator 38 via supply line 60S. The evaporator 38 may reduce the temperature of the cooling fluid in the tube bundle 58 via thermal heat transfer with the refrigerant. The tube bundle 58 in the evaporator 38 can include a plurality of tubes and/or a plurality of tube bundles. In any case, the vapor refrigerant exits the evaporator 38 and returns to the compressor 32 by a suction line to complete the cycle.

Figure 4:
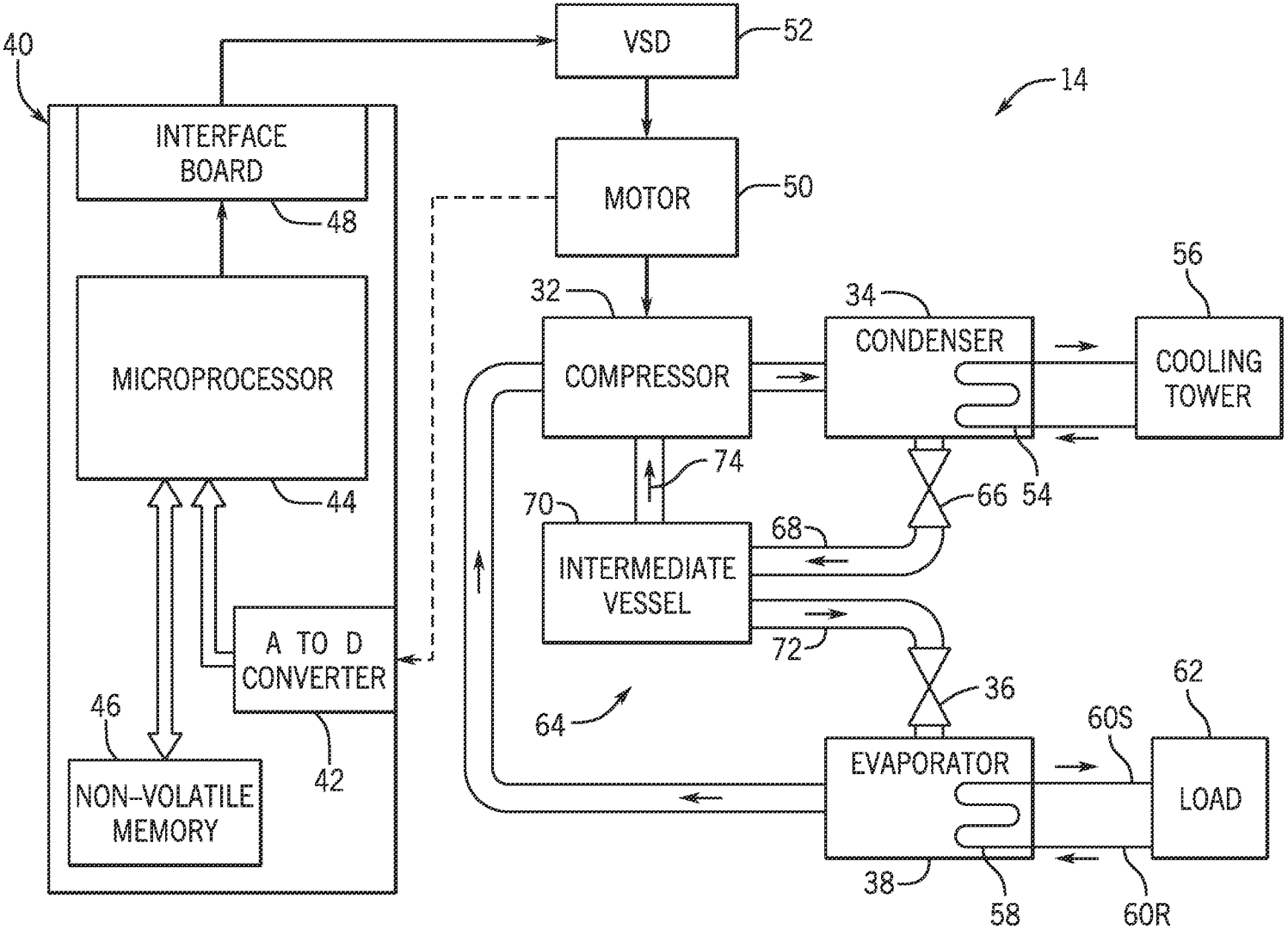
FIG. 4 is a schematic of an embodiment of a vapor compression system, in accordance with an aspect of the present disclosure.

FIG. 4 is a schematic of the vapor compression system 14 with an intermediate circuit 64 incorporated between condenser 34 and the expansion device 36. The intermediate circuit 64 may have an inlet line 68 that is directly fluidly connected to the condenser 34. In other embodiments, the inlet line 68 may be indirectly fluidly coupled to the condenser 34. As shown in the illustrated embodiment of FIG. 4, the inlet line 68 includes a first expansion device 66 positioned upstream of an intermediate vessel 70. In some embodiments, the intermediate vessel 70 may be a flash tank (e.g., a flash intercooler, an economizer, etc.). In other embodiments, the intermediate vessel 70 may be configured as a heat exchanger or a "surface economizer." In the illustrated embodiment of FIG. 4, the intermediate vessel 70 is used as a flash tank, and the first expansion device 66 is configured to lower the pressure of (e.g., expand) the liquid refrigerant received from the condenser 34. During the expansion process, a portion of the liquid may vaporize, and thus, the intermediate vessel 70 may be used to separate the vapor from the liquid received from the first expansion device 66.

Additionally, the intermediate vessel 70 may provide for further expansion of the liquid refrigerant because of a pressure drop experienced by the liquid refrigerant when entering the intermediate vessel 70 (e.g., due to a rapid increase in volume experienced when entering the intermediate vessel 70). The vapor in the intermediate vessel 70 may be drawn by the compressor 32 through a suction line 74 of the compressor 32. In other embodiments, the vapor in the intermediate vessel 70 may be drawn to an intermediate stage of the compressor 32 (e.g., not the suction stage). The liquid that collects in the intermediate vessel 70 may be at a lower enthalpy than the liquid refrigerant exiting the condenser 34 because of the expansion in the expansion device 66 and/or the intermediate vessel 70. The liquid from intermediate vessel 70 may then flow in line 72 through a second expansion device 36 to the evaporator 38.

It should be appreciated that any of the features described herein may be incorporated with the vapor compression system 14 or any other suitable HVAC&R systems. For example, the present techniques may be incorporated with any HVAC&R system having an economizer, such as the intermediate vessel 70, and a compressor, such as the compressor 32. The discussion below describes the present techniques incorporated with embodiments of the compressor 32 configured as a single stage compressor. However, it should be appreciated that the systems and methods described herein may be incorporated with other embodiments of the compressor 32 and HVAC&R system 10.

Embodiments of the present disclosure are directed to a compressor (e.g., compressor 32) having an impeller with a partial shroud. The compressor may include a first flow path through which a working fluid, such as a working fluid received from an evaporator, may flow. For example, the working fluid may flow through a suction inlet of the compressor, through the impeller, and into a diffuser passage via the first flow path. The compressor may also include a second flow path through which working fluid received from an economizer may flow. By way of example, the working fluid may flow from the economizer, through an unshrouded portion of the impeller, and into a section of the first flow path via the second flow path. Thus, the working fluid flowing from the economizer into the compressor may mix and combine with the working fluid directed through the first flow path. For instance, the working fluid may flow from the economizer into the first flow path at a location upstream of a tip of the impeller, such as a location where less than two-thirds of compressor lift has been provided to the working fluid flowing through the first flow path. Directing the working fluid to the location upstream of the tip of the impeller may improve mixture between the working fluid received via the economizer and the working fluid received via the suction inlet (e.g., from the evaporator) to improve operation of the compressor.

Figure 5:
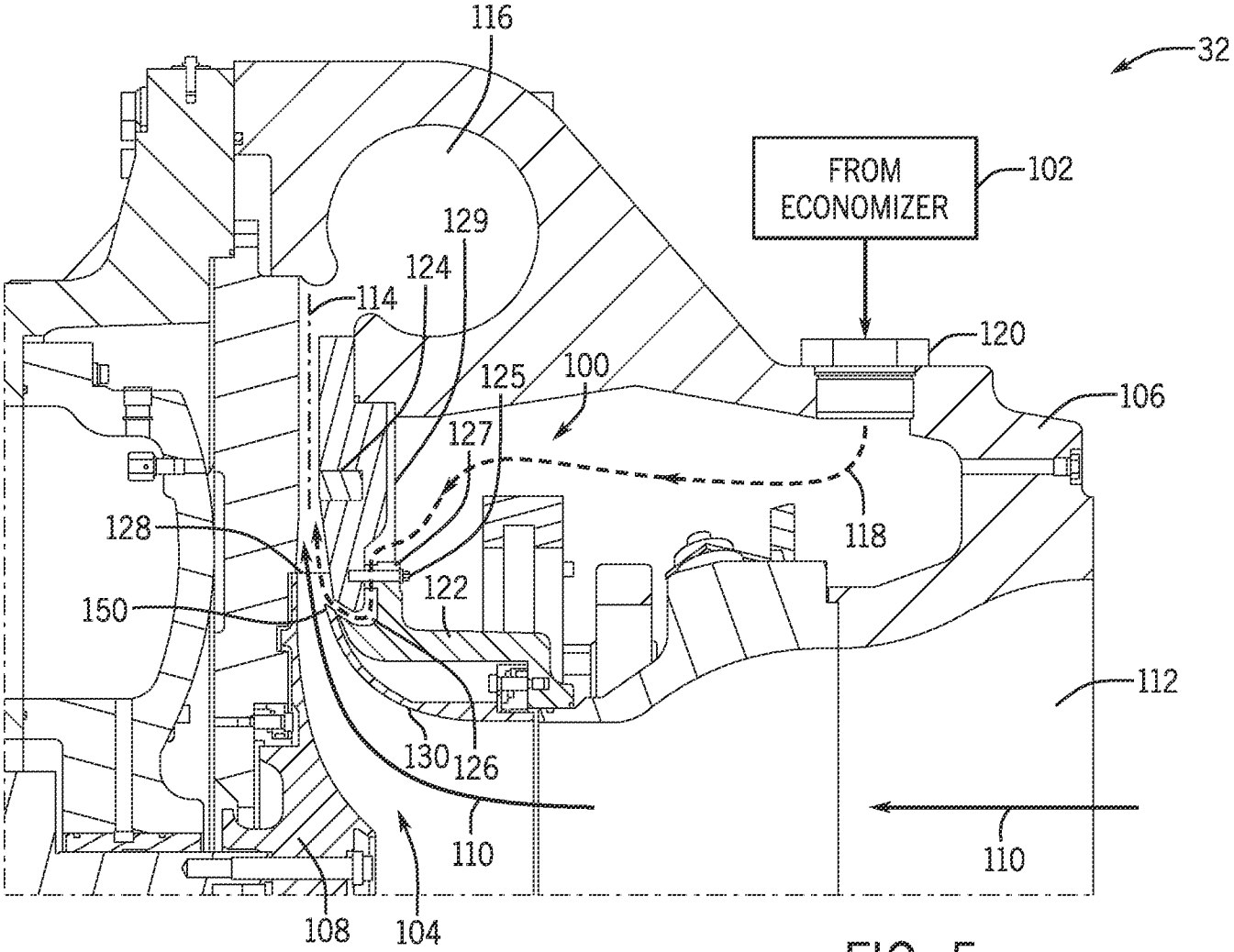
FIG. 5 is a partial cross-sectional side view of an embodiment of a compressor configured to receive a fluid flow from an economizer, in accordance with an aspect of the present disclosure.

With the foregoing in mind, FIG. 5 is a partial cross-sectional side view of an embodiment of the compressor 32, illustrating a working fluid flow path 100 of the compressor 32 configured to direct vapor working fluid (e.g., vapor refrigerant) from an economizer 102 (e.g., the intermediate vessel 70) into a main or primary working fluid flow path 104 of the compressor 32. For example, the compressor 32 may be a single stage compressor. The compressor 32 includes a housing 106 (e.g., a compressor housing) in which an impeller 108 is disposed. A main flow 110 (e.g., a primary flow, a first flow) of working fluid enters the housing 106 at a suction inlet 112 and is directed toward the impeller 108. The impeller 108 is driven into rotation by a motor (e.g., the motor 50) to impart mechanical energy into the main flow 110 of working fluid. The main flow 110 of working fluid exits the impeller 108 and is directed through a diffuser passage 114 (e.g., a pressure recovery portion) of the compressor 32 toward a volute 116 of the compressor 32. From the volute 116, the working fluid may be directed toward a condenser (e.g., the condenser 34) for heat exchange with a fluid, such as a cooling fluid.

As mentioned above, the compressor 32 is configured to receive a vapor working fluid 118 (e.g., a secondary flow, a second flow) from the economizer 102. To this end, the compressor 32 includes an economizer inlet port 120 fluidly coupled to the economizer 102. The economizer inlet port 120 directs the vapor working fluid 118 into the housing 106 along the working fluid flow path 100 formed therein. The working fluid flow path 100 directs the vapor working fluid 118 into the impeller 108 to combine with the main flow 110 of working fluid. For example, in the illustrated embodiment, the compressor 32 includes an eye seal support plate 122 (e.g., a first plate) coupled to a nozzle base plate 124 (e.g., a second plate) to cooperatively define an injection passage 126 (e.g., an annular passage) extending therebetween about the impeller 108. For example, fasteners 125 (e.g., bolts) may couple the eye seal support plate 122 and the nozzle base plate 124 to one another, and an opening or space (e.g., annular space) may be formed between adjacent fasteners 125 to enable the vapor working fluid 118 to flow from the economizer inlet port 120 into the injection passage 126. Further, mounts or bosses 127 of the eye seal support plate 122 through which the fasteners 125 may extend to couple the eye seal support plate 122 and the nozzle base plate 124 to one another may define the openings or spaces formed between the fasteners 125. The mounts 127 may have a geometric shape (e.g., an aerodynamic shape, profile, or configuration) to facilitate flow of the vapor working fluid 118 into the injection passage 126, such as a shape that reduces a flow resistance of the vapor working fluid 118. In additional or alternative embodiments, the injection passage 126 may be formed by or in other components of the compressor 32.

In certain embodiments, a cast vane or spacer 129 may be positioned between the eye seal support plate 122 and the nozzle base plate 124 to direct the vapor working fluid 118 into the injection passage 126. For example, the cast vane 129 may be positioned adjacent to one of the fasteners 125, such as at an intake of the injection passage 126. The cast vane 129 may offset the eye seal support plate 122 and the nozzle base plate 124 from one another to form a sufficiently sized space that enables the vapor working fluid 118 to enter the injection passage 126 at a desirable flow rate. The cast vane 129 may also adjust a flow direction of the vapor working fluid 118 entering the injection passage 126. For instance, the cast vane 129 may transition the vapor working fluid 118 into the injection passage 126 to flow with reduced obstruction caused by impingement against the eye seal support plate 122 and/or the nozzle base plate 124. Thus, the vapor working fluid 118 may flow at a desirable rate through the injection passage 126.

As noted above, the impeller 108 and the diffuser passage 114 of the compressor 32 may each be configured to provide a portion of the pressurization or "lift" of the working fluid compressed by the compressor 32. For example, the impeller 108 may provide approximately two-thirds of the total pressurization or "lift" provided by the compressor 32 to the main flow 110 of the working fluid, and the diffuser passage 114 may provide approximately one-third of the pressurization or "lift" provided by the compressor 32 to the main flow 110 of the working fluid. In the illustrated embodiment, the impeller 108 has an impeller tip 128 (e.g., a discharge tip, a first radial tip) from which the working fluid is discharged from the impeller 108 into the diffuser passage 114. Thus, at the impeller tip 128, the working fluid may have a pressure associated with an amount of lift or pressurization provided by the impeller 108 (e.g., approximately two-thirds of total lift provided by the compressor 32). However, the pressure of the working fluid at the impeller tip 128 may be greater than desired for introduction of the vapor working fluid 118 from the economizer 102 into the main flow 110 of the working fluid. Thus, the injection passage 126 of the working fluid flow path 100 is configured to direct the vapor working fluid 118 into the impeller 108 upstream of the impeller tip 128 (e.g., relative to a flow direction of the main flow 110 of working fluid through the impeller 108).

To this end, the impeller 108 includes a shroud 130 that terminates upstream (relative to a flow direction of the main flow 110 of working fluid) of the impeller tip 128. Thus, the vapor working fluid 118 from the economizer 102 may be directed into the impeller 108 (e.g., between blades of the impeller 108) via the injection passage 126 at a shroud tip 150 (e.g., a second radial tip) of the shroud 130, which is upstream of the impeller tip 128 relative to a flow of the main flow 110 of the working fluid. As such, the injection passage 126 may extend into the impeller 108 external to the shroud 130. The vapor working fluid 118 introduced into the impeller 108 from the economizer 102 combines with the main flow 110 of working fluid directed into the impeller 108 via the suction inlet 112, is pressurized by the impeller 108, and is discharged into the diffuser passage 114 at the impeller tip 128. In this way, the vapor working fluid 118 may be introduced into the main working fluid flow path 104 at a lower pressure than that of the working fluid at the impeller tip 128. For this reason, the operating pressure of the economizer 102 may be reduced (e.g., relative to the operating pressure of an economizer in which the working fluid is introduced from the economizer to the compressor 32 at the impeller tip 128) while enabling the vapor working fluid 118 to be adequately directed into the main working fluid flow path 104 and mix with the main flow 110 of the working fluid. The HVAC&R system 10 may therefore operate more efficiently.

Figure 6:
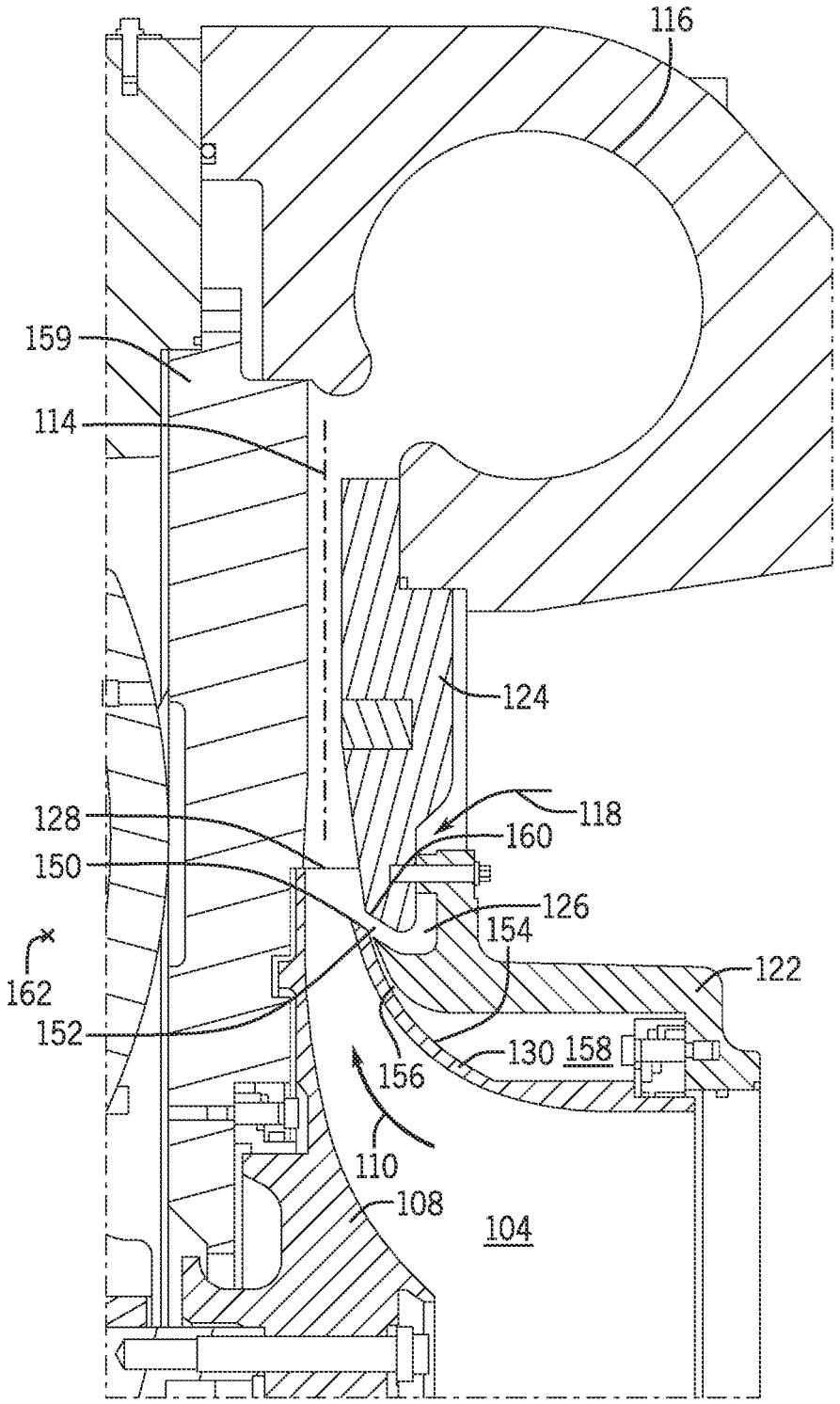
FIG. 6 is a partial cross-sectional side view of an embodiment of a compressor configured to receive a fluid flow from an economizer, in accordance with an aspect of the present disclosure.

FIG. 6 is a partial cross-sectional side view of an embodiment of the compressor 32, illustrating alignment of the injection passage 126 and the impeller 108. More specifically, the illustrated embodiment shows the injection passage 126 generally aligned with the shroud tip 150 of the shroud 130. As discussed above, the shroud tip 150 (e.g., a radially outer edge of the shroud 130) is disposed upstream of the impeller tip 128, which may be defined by a hub tip and/or blade tips of the impeller 108. Thus, the hub and/or the blades of the impeller 108 may extend radially outward (e.g., relative to a rotational axis of the impeller 108) and/or downstream of the shroud tip 150 (e.g., relative to a flow direction of the main flow 110 of working fluid directed through the impeller 108. In this way, the vapor working fluid 118 may be injected into the impeller 108 (e.g., between blades of the impeller 108) to combine with the main flow 110 of working fluid. In the illustrated embodiment, the eye seal support plate 122 and the nozzle base plate 124 are formed such that the injection passage 126 (e.g., an axis of the injection passage 126 extending through an outlet port 152 of the injection passage 126) extends along (e.g., generally parallel to) a surface of the shroud tip 150. In this way, the vapor working fluid 118 may be readily introduced into the impeller 108 with reduced fluidic resistance, pressure loss, velocity loss, etc. For example, the shroud tip 150 may be formed at an angle that is generally aligned with or corresponds with an axis of the injection passage 126 at the outlet port 152. Further, the alignment of the injection passage 126 at the outlet port 152 with the shroud tip 150 may mitigate contact between the vapor working fluid 118 and an outer shroud surface 154 of the shroud 130 as the vapor working fluid 118 is introduced into the impeller 108 and the main working fluid flow path 104. However, other embodiments of the compressor 32 (e.g., the impeller 108) may have other geometries or configurations to enable introduction of the vapor working fluid 118 upstream of the impeller tip 128 and the diffuser passage 114.

The illustrated eye seal support plate 122 may also block flow of the vapor working fluid 118 toward and/or along the outer shroud surface 154 and guide the vapor working fluid 118 toward the outlet port 152 and into the main working fluid flow path 104 (e.g., into the impeller 108). For example, the eye seal support plate 122 may form a chamber 158 between the eye seal support plate 122 and the outer shroud surface 154, and the eye seal support plate 122 may include a segment 156 (e.g., extension, flange, protrusion) that may block flow of the vapor working fluid 118 from the injection passage 126 into the chamber 158. Thus, the eye seal support plate 122 may direct the vapor working fluid 118 to flow from the injection passage 126 directly into the main working fluid flow path 104 (e.g., instead of into and/or within the chamber 158).

Downstream of the injection passage 126 and the shroud tip 150, the combined main flow 110 of working fluid and vapor working fluid 118 may flow along the diffuser passage 114 between the nozzle base plate 124 (e.g., a stationary shroud) and a diffuser plate 159 of the compressor 32 opposite the nozzle base plate 124 relative to the diffuser passage 114. Thus, as shown in the illustrated embodiment, the nozzle base plate 124 may overlap with a portion of the blades of the impeller 108 (e.g., along a flow direction of the main flow 110 of working fluid) to guide the combined main flow 110 of working fluid and the vapor working fluid 118 along the diffuser passage 114 after the vapor working fluid 118 is introduced into the impeller 108 via the injection passage 126. Furthermore, the nozzle base plate 124 may be aligned with a profile of the shroud 130. For example, a surface 160 of the nozzle base plate 124 may extend along (e.g., generally parallel to) the shroud tip 150 to avoid interrupting the flow of the vapor working fluid 118 through the injection passage 126 and into the impeller 108 (e.g., into the main flow 110 of working fluid). Thus, the nozzle base plate 124 may guide the vapor working fluid 118 into the impeller 108 with reduced fluidic resistance, pressure loss, velocity loss, and so forth associated with the flow of the vapor working fluid 118. Such geometry of the nozzle base plate 124 may also avoid interruption of the flow of the main flow 110 of working fluid through the diffuser passage 114. The nozzle base plate 124 may therefore enable mixture of the vapor working fluid 118 and the main flow 110 of working fluid without substantially impeding a flow of the vapor working fluid 118 and/or the main flow 110 of working fluid.

In some embodiments, the compressor 32 may further include one or more additional elements (e.g., a valve, a flow control device, a diffuser ring, etc.) to facilitate control of the vapor working fluid 118 flow into the impeller 108. Additionally or alternatively, a pressure level within the economizer 102 (e.g., relative to a pressure level within the impeller 108) may be controlled to adjust the vapor working fluid 118 flow (e.g., flow rate) into the impeller 108. For example, increasing the pressure level within the economizer 102 relative to the pressure level within the impeller 108 may increase the flow rate of the vapor working fluid 118 through the working fluid flow path 100. For instance, the pressurization of the compressor 32, the cooling of the working fluid via the condenser 34, the opening of the first expansion device 66, and the like, may be controlled and/or adjusted to control the pressure level within the economizer 102 and control the flow rate of the vapor working fluid 118 into the impeller 108.

Figure 7:
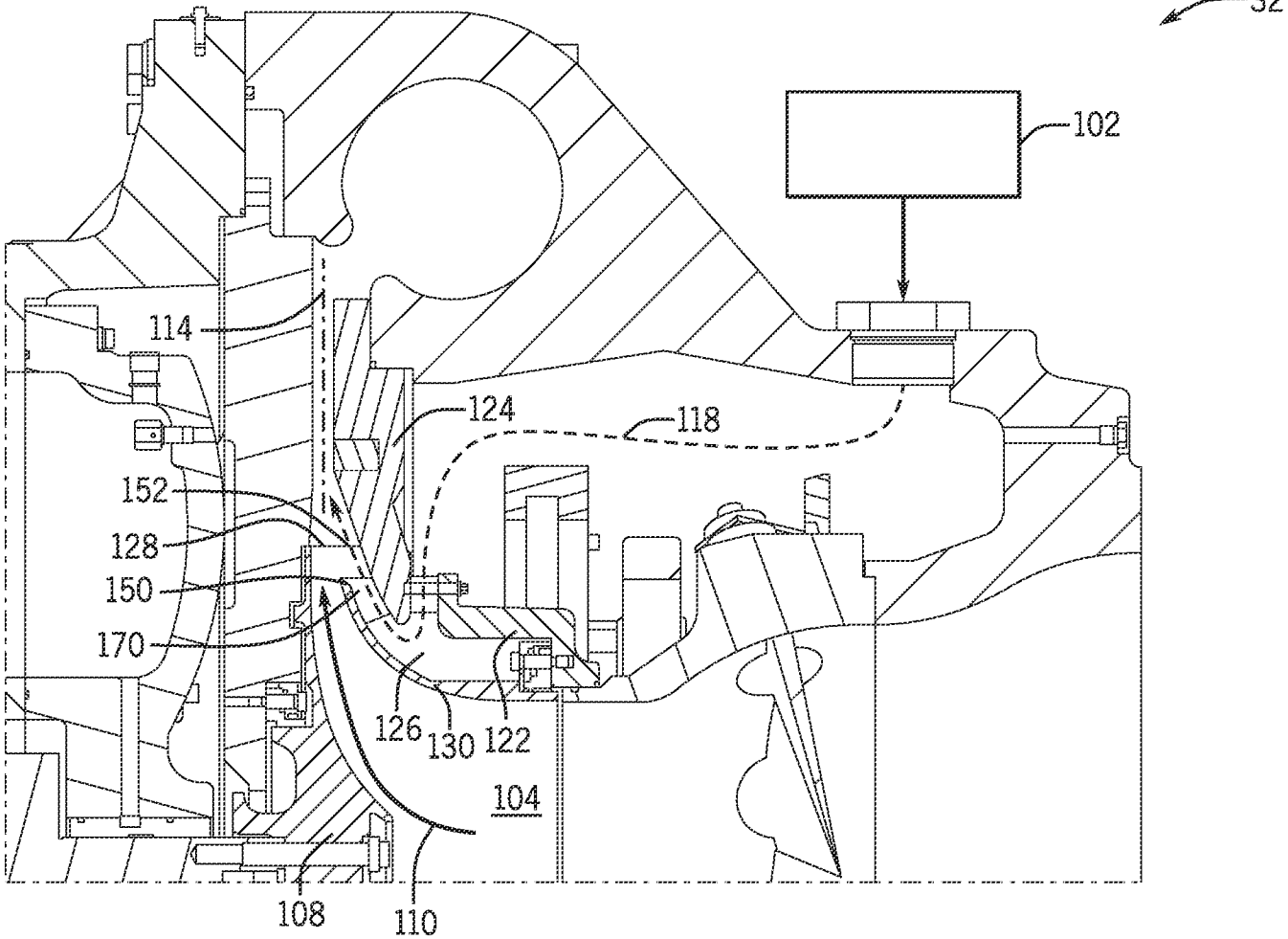
FIG. 7 is a partial cross-sectional side view of an embodiment of a compressor configured to receive a fluid flow from an economizer, in accordance with an aspect of the present disclosure.

FIG. 7 is a partial cross-sectional side view of an embodiment of the compressor 32 having a vane 170 (e.g., a stationary vane, pre-rotation vane, directing vane, guide vane) disposed within the injection passage 126 upstream of and adjacent to the shroud tip 150 relative to a flow of the vapor working fluid 118 through the injection passage 126. While the illustrated embodiment shows one vane 170 positioned within the injection passage 126, it should be appreciated that the compressor 32 may include multiple vanes 170 positioned within the injection passage 126 (e.g., arrayed circumferentially about the impeller 108). The vanes 170 may further guide the vapor working fluid 118 to flow into the main working fluid flow path 104 and enable improved mixing of the vapor working fluid 118 with the main flow 110 of working fluid. For example, the vanes 170 may direct the vapor working fluid 118 to enter the impeller 108 in a flow direction that approaches or is more aligned with a flow direction of the main flow 110 of working fluid (e.g., driven by the blades of the impeller 108) within and discharged by the impeller 108. In particular, the main flow 110 of working fluid may have an increased velocity in a radial direction 162 (e.g., relative to a rotational axis of the impeller 108), as compared to the vapor working fluid 118. The vanes 170 may therefore direct the vapor working fluid 118 into the impeller 108 to flow in a flow direction more aligned with the radial direction 162. Thus, the vane 170 may reduce undesirable characteristics of the combined vapor working fluid 118 and the main flow 110 of working fluid, such as a turbulence, pressure losses, velocity losses, and so forth, which may be caused by mixture of fluids flowing in different directions. As such, the vanes 170 may enable more efficient (e.g., more uniform) flow and mixture of the vapor working fluid 118 and the main flow 110 of working fluid.

The vanes 170 may be coupled (e.g., fixedly coupled) to the nozzle base plate 124 and may extend from the nozzle base plate 124 toward the shroud 130. The vanes 170 may remain stationary relative to the nozzle base plate 124 and, during operation of the compressor 32, the impeller 108 (e.g., the shroud 130, the blades of the impeller 108) may rotate relative to the nozzle base plate 124 and therefore relative to the vanes 170. The vanes 170 may terminate prior to contact with the shroud 130 to avoid interference with movement of the impeller 108 during the operation of the compressor 32. That is, the vanes 170 may be offset from the shroud 130 to form a space between the vanes 170 and the shroud 130 to mitigate contact between the vanes 170 and the shroud 130. In some embodiments, the vanes 170 may be integrally formed with the nozzle base plate 124. In additional or alternative embodiments, the vanes 170 may be formed as separate components from the nozzle base plate 124 and may therefore be secured to the nozzle base plate 124, such as with a fastener, a weld, an adhesive, and the like.

Figure 8:
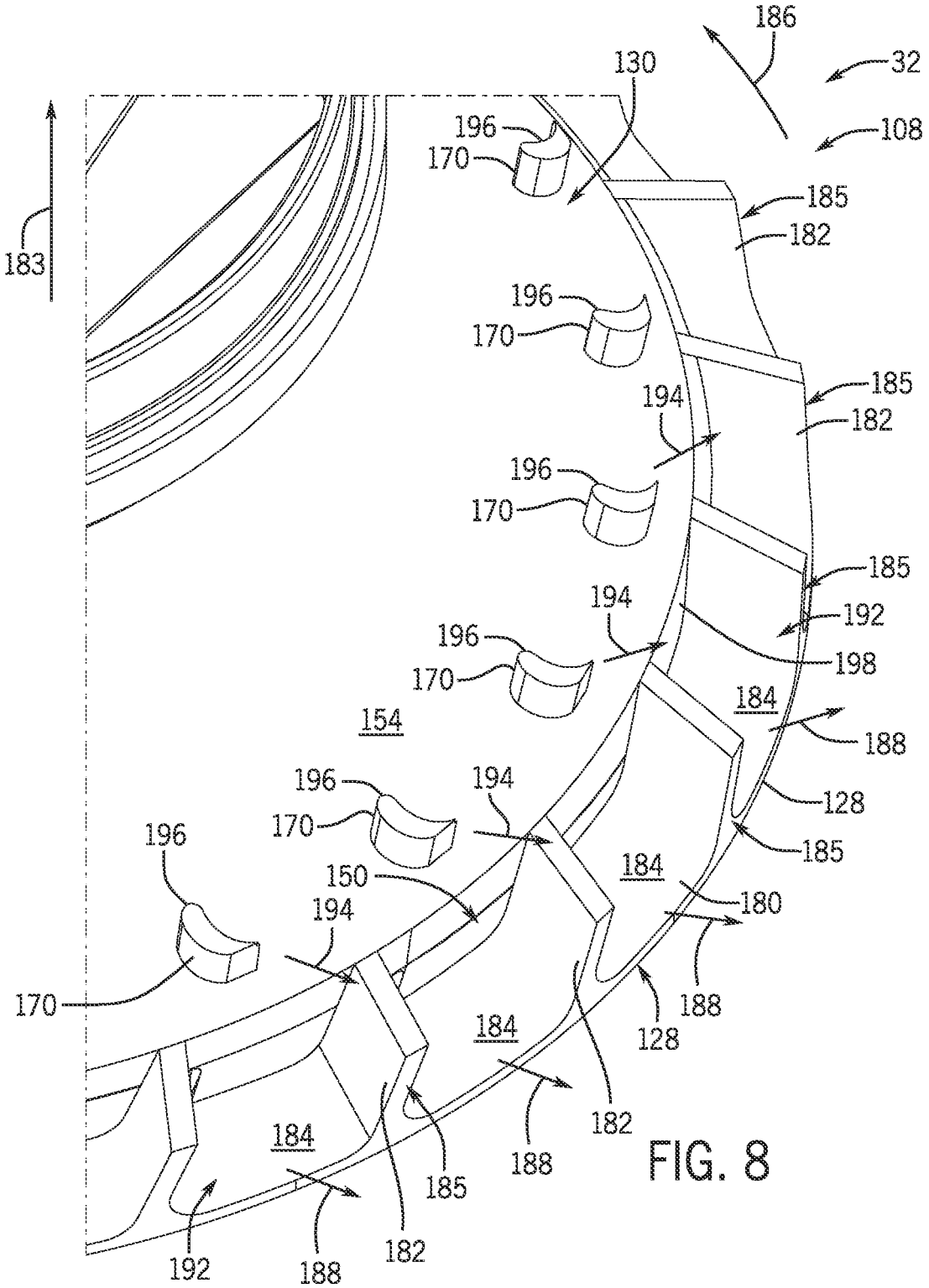
FIG. 8 is a partial perspective view of an embodiment of an impeller for a compressor configured to receive a fluid flow from an economizer, in accordance with an aspect of the present disclosure.

FIG. 8 is a partial perspective view of an embodiment of the impeller 108, illustrating the shroud tip 150 upstream of the impeller tip 128 relative to a flow direction of the main flow 110 of working fluid through the impeller 108. In the illustrated embodiment, a portion of the nozzle base plate 124 is not visible to better illustrate the geometry of the vanes 170 configured to guide the flow of the vapor working fluid 118 into the impeller 108. As shown, the impeller 108 includes the shroud 130, a hub portion 180 (e.g., a hub) defining the impeller tip 128, and a plurality of blades 182 extending between the hub portion 180 and the shroud 130 to define a plurality of flow paths 184 extending through the impeller 108. The blades 182 may be contained within the profile of the shroud 130. That is, the blades 182 may not extend beyond the shroud 130 from the hub portion 180 and may therefore be axially contained within the shroud 130 relative to a rotational axis 183 of the impeller 108). Thus, the blades 182 may not disrupt the flow of the vapor working fluid 118 directed into the flow paths 184. Additionally, each of the blades 182 may extend (e.g., extend radially outward) from the shroud tip 150 to provide an increased surface area of the blades 182 for imparting mechanical force or energy to the main flow 110 of working fluid and the vapor working fluid 118. As a result, each of the blades 182 may include a blade tip 185 that is disposed proximate to the impeller tip 128 and upstream of the diffuser passage 114 relative to a direction of the main flow 110 of working fluid through the impeller 108 via the flow paths 184. In this manner, the shroud tip 150 may be disposed upstream of the blade tip 185 of each of the blades 182 relative to the direction of the main flow 110 of working fluid through the impeller 108.

The main flow 110 of working fluid directed through the impeller 108 flows through the plurality of flow paths 184 defined by the hub portion 180, the shroud 130, and the plurality of blades 182 as the impeller 108 is driven into rotation. For example, the impeller 108 may rotate in a rotational direction 186 (e.g., about a rotational axis 183) and may cause the main flow 110 of working fluid to flow through the plurality of flow paths 184 in first flow directions 188 that extend crosswise to a radius of the hub portion 180 (e.g., obliquely relative to a circumference of the hub portion 180). That is, the main flow 110 of working fluid may flow at least partially tangentially (e.g., relative to a circumference of the hub portion 180) through the plurality of flow paths 184. For example, impingement of the main flow 110 of working fluid against the blades 182 during rotation of the impeller 108 in the rotational direction 186 may drive flow of the main flow 110 of working fluid along the first flow directions 188.

As discussed above, the impeller 108 is configured to enable mixing of the vapor working fluid 118 received from the economizer 102 with the main flow 110 of working fluid received by the compressor 32 via the suction inlet 112. Specifically, the shroud 130 includes the shroud tip 150, which is upstream of the impeller tip 128 relative to a direction of the main flow 110 of working fluid through the impeller 108. Thus, portions 192 of the flow paths 184 are at least partially exposed (e.g., unshrouded, not constrained or shielded by the shroud 130, etc.), which enables the vapor working fluid 118 to enter the flow paths 184 and mix with the main flow 110 of working fluid upstream of the impeller tip 128 that is adjacent to the diffuser passage 114. However, it should be noted that a part of the portions 192 of the flow paths 184 may be shrouded downstream of the shroud tip 150 and the injection passage 126, but upstream of the impeller tip 128 (e.g., relative to the direction of the main flow 110 of working fluid through the impeller 108). For example, as discussed above and shown in FIGS. 5-7, the nozzle base plate 124 may shroud a part of the portions 192 and the blades 182 to guide the combined vapor working fluid 118 and main flow 110 of working fluid through the diffuser passage 114.

The vapor working fluid 118 may enter the flow paths 184 adjacent to the shroud tip 150, which may be aligned with the outlet port 152 of the injection passage 126, as discussed above. In this way, the vapor working fluid 118 from the economizer 102 may enter the compressor 32 at a lower pressure (e.g., as compared to a pressure at the impeller tip 128), which enables operation of the economizer 102 at a lower pressure to achieve improved operation and efficiency of the HVAC&R system 10. For example, the pressure at which the vapor working fluid 118 enters the flow paths 184 may be approximately fifty percent of a total lift (e.g., a pressure rise from the suction inlet 112 to an exit or outlet of the diffuser passage 114) of the compressor 32. The disclosed embodiments and techniques also enable utilization of the economizer 102 in HVAC&R systems 10 having single stage compressors (e.g., the compressor 32).

In addition, the vanes 170 may direct the vapor working fluid 118 into the flow paths 184 downstream of the impeller tip 128 and upstream of the blade tips 185. For example, the vanes 170 may adjust a flow direction of the vapor working fluid 118 upstream of the portions 192 of the flow paths 184 and/or the shroud tip 150 relative to a flow of the vapor working fluid 118 through the injection passage 126 to more readily and efficiently combine with the main flow 110 of working fluid. For example, a surface 196 of each vane 170 may guide the vapor working fluid 118 to flow in second flow directions 194 to redirect the flow direction of the vapor working fluid 118 toward closer alignment with or to approach the first flow directions 188 of the main flow 110 of working fluid. That is, the second flow directions 194 of the vapor working fluid 118 may be crosswise relative to a radius of the hub portion 180 and more closely align with corresponding first flow directions 188 of the main flow 110 of working fluid. As such, the flows of the main flow 110 of working fluid and the vapor working fluid 118 may flow and mix more efficiently (e.g., with reduced turbulence, pressure losses, and/or velocity losses) relative to flows of the main flow 110 of working fluid and the vapor working fluid 118 traveling in more disparate directions. Indeed, in the illustrated embodiment, a location where the main flow 110 of working fluid and the vapor working fluid 118 combine and mix may have increased uniform and velocity distribution. Although the illustrated vanes 170 have surfaces 196 with a curved geometry to guide the vapor working fluid 118 into the flow paths 184, additional or alternative vanes 170 may have surfaces 196 with any suitable geometry, such as a linear geometry, that may adjust the vapor working fluid 118 to flow in the second flow directions 194 or other suitable direction more aligned with the first flow directions 188. Furthermore, the compressor 32 may include any suitable number of vanes 170, such as more vanes 170 than blades 182, fewer vanes 170 than blades 182, or the same number of vanes 170 as blades 182.

In some embodiments, a location of the shroud tip 150 (e.g., relative to the impeller tip 128) may be selected based on a desired pressure of the vapor working fluid 118 entering the flow paths 184 of the impeller 108 (e.g., based on a desired operating pressure of the economizer 102). Further, a configuration or geometry of the shroud tip 150 may be selected based on other desired flow characteristics of the vapor working fluid 118. For example, the shroud tip 150 may have a surface 198 (e.g., a radially outer surface) that may be arcuate, curved, pointed, angled relative to the direction of the main flow 110 (e.g., 40, 45, 50, 55, or 60 degrees), U-shaped, or any other suitable geometry. Indeed, the impeller 108 may have any suitable geometry or configuration that facilitates flow of the vapor working fluid 118 and/or the main flow 110 of working fluid.

The present disclosure may provide one or more technical effects useful in the operation of an HVAC&R system. For example, the HVAC&R system may include a compressor may include an impeller configured to receive working fluid from a suction inlet and pressurize the working fluid via a compressor flow path. The impeller may also be configured to receive the working fluid from an economizer and direct the working fluid from the economizer to the compressor flow path. For example, the impeller may include a shroud having a tip that is upstream of a tip of the impeller such that a portion of the impeller is unshrouded. The working fluid from the economizer may be directed into the compressor flow path from the unshrouded portion of the impeller and mix with a remainder of the working fluid. Directing the working fluid from the economizer into the compressor flow path via the unshrouded portion may introduce the working fluid into the compressor flow path at a desired pressure, such as a pressure that is lower than the pressure of the working fluid downstream of the tip of the impeller, and may improve the mixture between the working fluid flowing through the compressor flow path from the suction inlet and the working fluid flowing through the compressor flow path from the economizer. Thus, operation of the compressor may be improved. The technical effects and technical problems in the specification are examples and are not limiting. It should be noted that the embodiments described in the specification may have other technical effects and can solve other technical problems.

While only certain features of present embodiments have been illustrated and described herein, many modifications and changes will occur to those skilled in the art. It is, therefore, to be understood that the appended claims are intended to cover all such modifications and changes that fall within the true spirit of the disclosure. Further, it should be understood that certain elements of the disclosed embodiments may be combined or exchanged with one another.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A compressor for a heating, ventilating, air conditioning, and refrigeration (HVAC&R) system, comprising:

an impeller, comprising:

a hub defining an impeller tip;

a plurality of blades coupled to the hub, wherein the plurality of blades defines a plurality of flow paths configured to direct a primary flow of working fluid therethrough; and a shroud coupled to the plurality of blades, wherein the shroud comprises a radial shroud tip disposed upstream of the impeller tip relative to a flow direction of the primary flow of working fluid through the plurality of flow paths; and a vane disposed upstream of the radial shroud tip, wherein the vane is configured to guide a vapor working fluid to flow into the plurality of flow paths, and the vane is separate from the plurality of blades.

2. The compressor of claim 1, comprising a first plate and a second plate cooperatively defining a passage therebetween, wherein the passage is external to the shroud and is configured to direct the vapor working fluid into the plurality of flow paths.

3. The compressor of claim 2, wherein the passage is configured to receive the vapor working fluid from an economizer of the HVAC&R system.

4. The compressor of claim 2, wherein the passage comprises an outlet port configured to direct the vapor working fluid into the plurality of flow paths upstream of the impeller tip relative to the flow direction of the primary flow of working fluid through the plurality of flow paths.

5. The compressor of claim 2, wherein the first plate comprises an extension configured to block flow of the vapor working fluid into a chamber formed between the first plate and the shroud.

6. The compressor of claim 2, wherein the passage comprises an annular passage.

7. The compressor of claim 2, wherein the vane comprises a stationary vane disposed in the passage.

8. A compressor for a heating, ventilating, air conditioning, and refrigeration (HVAC&R) system, comprising:

an impeller, comprising:

a hub comprising a first radial tip;

a plurality of blades extending from the hub and defining a plurality of flow paths configured to direct a primary flow of working fluid therethrough; and a shroud coupled to the plurality of blades and comprising a second radial tip disposed upstream of the first radial tip of the hub relative to a first flow direction of the primary flow of working fluid through the plurality of flow paths;

a compressor housing, wherein the impeller is disposed within the compressor housing, and the compressor housing comprises a working fluid flow path extending therethrough and configured to receive a vapor working fluid from an economizer and direct the vapor working fluid into the plurality of flow paths; and a plurality of vanes, separate from the plurality of blades, disposed within the working fluid flow path, wherein the plurality of vanes is configured to adjust a second flow direction of the vapor working fluid through the working fluid flow path.

9. The compressor of claim 8, wherein the plurality of vanes is configured to adjust the second flow direction of the vapor working fluid to approach the first flow direction of the primary flow of working fluid.

10. The compressor of claim 8, wherein the plurality of blades is axially contained within the shroud relative to a rotational axis of the impeller.

11. The compressor of claim 8, wherein each vane of the plurality of vanes is disposed adjacent to the second radial tip of the shroud.

12. The compressor of claim 11, wherein the plurality of vanes comprises a plurality of stationary vanes, and the impeller is configured to rotate relative to the plurality of vanes during operation of the compressor.

13. The compressor of claim 11, wherein each vane of the plurality of vanes comprises a curved surface configured to adjust the second flow direction of the vapor working fluid through the working fluid flow path.

14. A compressor for a heating, ventilating, air conditioning, and refrigeration (HVAC&R) system, comprising:

a housing comprising a vapor working fluid flow path extending therethrough, wherein the vapor working fluid flow path is configured to receive a vapor working fluid from an economizer of the HVAC&R system;

an impeller disposed within the housing, wherein the impeller comprises:

a plurality of blades defining a plurality of flow paths configured to direct a primary flow of working fluid therethrough, wherein each blade of the plurality of blades comprises a first tip; and a shroud coupled to the plurality of blades and comprising a second tip disposed upstream of the first tip of each blade of the plurality of blades relative to a flow direction of the primary flow of working fluid through the plurality of flow paths; and a stationary vane disposed within the vapor working fluid flow path and configured to adjust a flow direction of the vapor working fluid upstream of the second tip of the shroud and direct the vapor working fluid into the plurality of flow paths downstream of the second tip of the shroud and upstream of the first tip of each blade of the plurality of blades.

15. The compressor of claim 14, wherein the stationary vane is configured to adjust the flow direction of the vapor working fluid to approach the flow direction of the primary flow of working fluid through the plurality of flow paths.

16. The compressor of claim 14, wherein the compressor is configured to receive the primary flow of working fluid from an evaporator of the HVAC&R system.

17. The compressor of claim 14, comprising a diffuser passage formed within the housing, wherein the first tip of each blade of the plurality of blades is disposed upstream of the diffuser passage relative to the flow direction of the primary flow of working fluid through the plurality of flow paths.

18. The compressor of claim 14, wherein the vapor working fluid flow path comprises an annular passage extending about the impeller.

19. The compressor of claim 14, wherein the stationary vane comprises a curved surface configured to guide the vapor working fluid into the plurality of flow paths to adjust the flow direction of the vapor working fluid.

20. The compressor of claim 14, wherein the vapor working fluid flow path comprises an outlet port disposed adjacent to the second tip of the shroud.

* * * * *